US010123942B2

(12) United States Patent
Miyake

(10) Patent No.: US 10,123,942 B2
(45) Date of Patent: Nov. 13, 2018

(54) TABLET PRINTING APPARATUS AND TABLET PRINTING METHOD

(71) Applicant: SCREEN HOLDINGS CO., LTD., Kyoto (JP)

(72) Inventor: Takashi Miyake, Kyoto (JP)

(73) Assignee: Screen Holdings Co., Ltd., Kyoto (JP)

( * ) Notice: Subject to any disclaimer, the term of this patent is extended or adjusted under 35 U.S.C. 154(b) by 0 days.

(21) Appl. No.: 15/744,724

(22) PCT Filed: Jun. 20, 2016

(86) PCT No.: PCT/JP2016/068230
§ 371 (c)(1),
(2) Date: Jan. 12, 2018

(87) PCT Pub. No.: WO2017/038212
PCT Pub. Date: Mar. 9, 2017

(65) Prior Publication Data

US 2018/0200149 A1 Jul. 19, 2018

(30) Foreign Application Priority Data

Sep. 2, 2015 (JP) ..... 2015-172469

(51) Int. Cl.
*B41C 1/02* (2006.01)
*A61J 3/06* (2006.01)
(Continued)

(52) U.S. Cl.
CPC ..... *A61J 3/06* (2013.01); *B05C 5/001* (2013.01); *B41F 17/36* (2013.01); *B41J 2/01* (2013.01)

(58) Field of Classification Search
None
See application file for complete search history.

(56) References Cited

U.S. PATENT DOCUMENTS 7,827,911 B2 * 11/2010 Kettinger ..... B41F 17/36 101/163
8,323,623 B2 * 12/2012 Klocke ..... A61J 3/007 264/319
(Continued)

FOREIGN PATENT DOCUMENTS

JP 2009-196123 A 9/2009
JP 2010-137453 A 6/2010
(Continued)

OTHER PUBLICATIONS

Search Report issued in corresponding International Patent Application No. PCT/JP2016/068230, dated Aug. 23, 2016.

*Primary Examiner* — Dung D Tran
(74) *Attorney, Agent, or Firm* — McDermott, Will & Emery LLP

(57) ABSTRACT

A tablet printing apparatus first applies either ultraviolet rays or infrared rays to surfaces of tablets that are being conveyed. The ultraviolet or infrared rays are applied to at least a contour portion of a target area where a print image is to be formed. In the case of applying ultraviolet rays, the surface of the contour portion is roughened, and the angle of contact with ink is reduced. In the case of applying infrared rays, the contour portion is etched into a recessed shape. Thereafter, ink is ejected inside the contour portion. This configuration suppresses the spread of the ejected ink to the outside of the target area. As a result, the print image has a well-defined contour.

20 Claims, 11 Drawing Sheets

(51) Int. Cl.

| | |
|---|---|
| ***B41J 2/01*** | (2006.01) |
| ***B05C 5/00*** | (2006.01) |
| ***B41F 17/36*** | (2006.01) |

(56) References Cited

U.S. PATENT DOCUMENTS

| | | | | |
|---|---|---|---|---|
| 9,517,639 | B2 * | 12/2016 | Hara | B41J 3/407 |
| 9,710,901 | B2 * | 7/2017 | Seo | B23K 26/0084 |
| 9,987,864 | B2 * | 6/2018 | Nakano | A61J 3/06 |
| 9,988,542 | B2 * | 6/2018 | Ozaki | B41M 5/0047 |
| 2005/0099476 | A1 * | 5/2005 | Chinea | A61K 9/2072 347/100 |
| 2006/0222704 | A1 * | 10/2006 | Barreto | A61J 3/007 424/464 |
| 2008/0252690 | A1 * | 10/2008 | Van Brocklin | B41J 3/546 347/51 |
| 2009/0207203 | A1 | 8/2009 | Yamamoto | |
| 2014/0168309 | A1 | 6/2014 | Morita et al. | |
| 2015/0174916 | A1 | 6/2015 | Hara et al. | |
| 2018/0170068 | A1 * | 6/2018 | Hirano | A61J 3/06 |

FOREIGN PATENT DOCUMENTS

| | | | |
|---|---|---|---|
| JP | 2013-006308 | A | 1/2013 |
| JP | 2013-013711 | A | 1/2013 |
| WO | 2014/013974 | A1 | 1/2014 |

* cited by examiner

TABLET PRINTING APPARATUS AND TABLET PRINTING METHOD

CROSS REFERENCE

This application is the U.S. National Phase under 35 U.S.C. § 371 of International Application No. PCT/JP2016/068230, filed on Jun. 20, 2016, which claims the benefit of Japanese Application No. 2015-172469, filed on Sep. 2, 2015, the entire contents of each are hereby incorporated by reference.

TECHNICAL FIELD

The present invention relates to a tablet printing apparatus and a tablet printing method for performing printing on tablet surfaces.

BACKGROUND ART

Tablets used as medicines often have their surfaces engraved with an inscription during tablet molding or printed with letters or codes after molding in order to help product recognition. Contact printing methods have conventionally been used in the printing of tablets. For example, a method using a printing plate such as gravure printing is employed in which ink is once transferred to a soft pad and then re-transferred to tablets.

In recent years, orally disintegrating tablets that can be taken without water have gradually become common. Since the orally disintegrating tablets are vulnerable to pressure, the contact printing methods as described above may damage tablets due to the pressure of printing plates. That is, the printing methods that bring printing plates into contact with tablets may yield defective tablets. Meanwhile, scored tablets that can be split into halves along a parting line are also becoming widely available. In the printing of scored tablets, it is necessary to perform printing in accordance with the orientations of parting lines on a plurality of scored tablets that are being conveyed. In view of this, there has been increasing demand for inkjet tablet printing apparatuses that are capable of non-contact printing and capable of easily controlling print orientation.

One example of the inkjet tablet printing apparatuses is described in, for example, Patent Literature 1.

CITATION LIST

Patent Literature

Patent Literature 1: Japanese Patent Application Laid-Open No. 2013-13711

SUMMARY OF INVENTION

Technical Problem

In some countries, in particular Europe and America, tablets in a bottle may be provided to patients. In the bottle, tablets printed with letters or other symbols by conventional inkjet printing methods may rub against each other, causing degradation in print quality and reducing their recognizability.

In the inkjet printing methods, ink that has a lower viscosity than that used in the printing methods using printing plates is directly ejected to tablets. Thus, depending on the components and surface conditions of the tablets, there are problems such as that printed letters are distorted as a result of the ink flowing along tablet surfaces due to poor adhesion, and that printed images are likely to have poorly defined contours. Especially in recent years, along with an increase in the type of generic medicines, there has been increasing demand to print much more information, such as the logos of manufacturers and the amount of components, on tablets for differentiation. There is also an increasing number of tablets such as soft capsules and film-coated or sugar-coated tablets that are difficult to get a clear inkjet print due to their surface conditions being affected by materials used to coat the tablets. Some tablets such as sugar-coated tablets have surfaces coated with wax components in order to put a shine thereon. In that case, clear printing is difficult with conventional inkjet printing using conventional water-based ink for tablets, because the ink cannot be stably fixed to oily tablet surfaces. In some cases, tablets themselves may be printed with bar codes or QR codes (registered trademark) in order to avoid a mix-up of tablets. Thus, there is demand for techniques capable of clearly printing detailed images on tablet surfaces. For high-value tablets, there are also needs to use different print techniques other than conventional techniques for the purpose of preventing forgery and to print tablets with colors or images that are difficult to discriminate with human eyes.

The present invention has been achieved in light of such circumstances, and it is an object of the present invention to provide a tablet printing apparatus and a tablet printing method for forming print images with well-defined contours on tablet surfaces.

Solution to Problem

To solve the problems described above, a first aspect of the present invention is a tablet printing apparatus for performing printing on a surface of a tablet. The tablet printing apparatus includes a conveying mechanism that holds and conveys a tablet, an exposure part that applies at least one of ultraviolet rays and infrared rays to a surface of a tablet that is conveyed by the conveying mechanism, and an inkjet head that ejects ink toward a surface of a tablet that has passed through the exposure part. The exposure part applies at least one of ultraviolet rays and infrared rays to at least a contour portion of a target area where a print image is to be formed, and the inkjet head ejects ink inside the contour portion.

A second aspect of the present invention is the tablet printing apparatus according to the first aspect, in which the exposure part applies at least ultraviolet rays to a surface of a tablet.

A third aspect of the present invention is the tablet printing apparatus according to the first or second aspect, in which the exposure part applies at least infrared rays to a surface of a tablet.

A fourth aspect of the present invention is the tablet printing apparatus according to the third aspect, in which the target area includes the contour portion, and an inside portion surrounded by the contour portion. The amount of infrared rays applied per unit area to the contour portion is greater than the amount of infrared rays applied per unit area to the inside portion.

A fifth aspect of the present invention is the tablet printing apparatus according to the fourth aspect, in which the exposure part includes one or more exposure parts that apply infrared rays to both of the contour portion and the inside portion.

A sixth aspect of the present invention is the tablet printing apparatus according to any one of the third to fifth aspects, in which the target area includes a first area that is irradiated with infrared rays, and a second area that is irradiated with a smaller amount of infrared rays per unit area than the first area, or that is not irradiated with infrared rays. The first area and the second area are alternately arranged in the target area.

A seventh aspect of the present invention is the tablet printing apparatus according to any one of the first to sixth aspects, in which the exposure part applies at least one of ultraviolet rays and infrared rays to a surface of a tablet via a spatial light modulator or a crystal optical element.

An eighth aspect of the present invention is the tablet printing apparatus according to any one of the first to seventh aspects, in which the exposure part includes a light source that emits at least one of ultraviolet rays and infrared rays, an optical system that guides the light emitted from the light source to a tablet, and a housing that houses at least part of the optical system and has an optically transparent window part located between the optical system and the conveying mechanism.

A ninth aspect of the present invention is the tablet printing apparatus according to the eighth aspect, in which the exposure part further includes a blowing mechanism for blowing gas to a surface of the window part, the surface being on the same side as the conveying mechanism.

A tenth aspect of the present invention is the tablet printing apparatus according to any one of the first to ninth aspects, in which the exposure part emits at least one of ultraviolet laser light and infrared laser light.

An eleventh aspect of the present invention is the tablet printing apparatus according to any one of the first to tenth aspects. The tablet printing apparatus further includes a fixing part disposed downstream of the inkjet head in a conveyance direction. The fixing part applies infrared rays to an irradiation area by one or more of following methods: continuous irradiation, flash irradiation, and laser irradiation, the irradiation area including at least part of a print area of a surface of a tablet.

A twelfth aspect of the present invention is a tablet printing method for performing printing on a surface of a tablet. The tablet printing method includes the steps of a) applying at least one of ultraviolet rays and infrared rays to a surface of a tablet that is conveyed, and b) ejecting ink toward the surface of the tablet after the step a). In the step a), at least one of ultraviolet rays and infrared rays is applied to at least a contour portion of a target area where a print image is to be formed, and in the step b), ink is ejected inside the contour portion.

A thirteenth aspect of the present invention is the tablet printing method according to the twelfth aspect, in which, in the step a), at least ultraviolet rays are applied to a surface of a tablet.

A fourteenth aspect of the present invention is the tablet printing method according to the twelfth or thirteenth aspect, in which, in the step a), at least infrared rays are applied to a surface of a tablet.

A fifteenth aspect of the present invention is the tablet printing method according to the fourteenth aspect, in which the target area includes the contour portion, and an inside portion surrounded by the contour portion. The amount of infrared rays applied per unit area to the contour portion is greater than the amount of infrared rays applied per unit area to the inside portion.

A sixteenth aspect of the present invention is the tablet printing method according to the fifteenth aspect, in which the step a) includes the steps of a-1) applying infrared rays to both of the contour portion and the inside portion, and a-2) applying infrared rays to only the contour portion before or after the step a-1).

A seventeenth aspect of the present invention is the tablet printing method according to any one of the fourteenth to sixteenth aspects, in which the target area includes a first area that is irradiated with infrared rays, and a second area that is irradiated with a smaller amount of infrared rays per unit area than the first area, or that is not irradiated with infrared rays. The first area and the second area are alternately arranged in the target area.

An eighteenth aspect of the present invention is the tablet printing method according to any one of the twelfth to seventeenth aspects, in which, in the step a), at least one of ultraviolet rays and infrared rays is applied to a surface of a tablet via a spatial light modulator or a crystal optical element.

A nineteenth aspect of the present invention is the tablet printing method according to any one of the twelfth to eighteenth aspects, in which, in the step a), at least one of ultraviolet laser light and infrared laser light is applied.

A twentieth aspect of the present invention is the tablet printing method according to any one of the twelfth to nineteenth aspects. The tablet printing method further includes the step of, after the step b), applying infrared rays to an irradiation area by one or more of following methods: continuous irradiation, flash irradiation, and laser irradiation, the irradiation area including at least part of a print area of a surface of a tablet.

Advantageous Effects of Invention

According to the first to twentieth aspects of the present invention, the surface shape of at least the contour portion of the target area is changed using at least one of ultraviolet rays and infrared rays. Then, ink is ejected inside the contour portion. This suppresses the spread of the ejected ink to the outside of the target area. As a result, the image has a well-defined contour.

In particular, according to the second and thirteenth aspects of the present invention, organic substances adhering to the surface of the tablet are decomposed by irradiation with ultraviolet rays so that the surface of the tablet has an affinity for water and is roughened, thereby having a smaller angle of contact with water-based ink. Then, ink is ejected inside the contour portion having a small angle of contact. This suppresses the spread of the ejected ink to the outside of the target area.

In particular, according to the third and fourteenth aspects of the present invention, the surface of the tablet is etched into a recessed shape by the application of infrared rays. Then, ink is ejected inside the etched contour portion. This suppresses the spread of the ejected ink to the outside of the target area.

In particular, according to the fourth and fifteenth aspects of the present invention, the contour portion can be etched more deeply than the inside portion. This further suppresses the spread of the ejected ink to the outside of the target area.

In particular, according to the fifth and sixteenth aspects of the present invention, the contour portion can be etched more deeply than the inside portion by two-step irradiation with infrared rays.

In particular, according to the sixth and seventeenth aspects of the present invention, the flow of the ejected ink can be suppressed. This further suppresses the spread of the ejected ink to the outside of the target area.

In particular, according to the seventh and eighteenth aspects of the present invention, the pattern of irradiation with light can be easily controlled.

In particular, according to the eighth aspect of the present invention, it is possible to prevent fine powder generated from tablets from adhering to the optical system.

In particular, according to the ninth aspect of the present invention, it is possible to prevent fine powder generated from tablets from adhering to the window part.

In particular, according to the eleventh and twentieth aspects of the present invention, the ink surface is reliably dried by irradiation with infrared rays after the printing of the tablet. This reduces damage that may occur to the surface of the ink on the printed portion when the tablet is removed from the holder and mixed with other tablets.

DESCRIPTION OF EMBODIMENTS

Hereinafter, embodiments of the present invention will be described with reference to the drawings. In the following description, a direction in which a plurality of tablets are conveyed is referred to as a "conveyance direction," and a direction perpendicular and parallel to the conveyance direction is referred to as a "width direction."

1. First Embodiment

1-1. Configuration of Tablet Printing Apparatus

Figure 1:
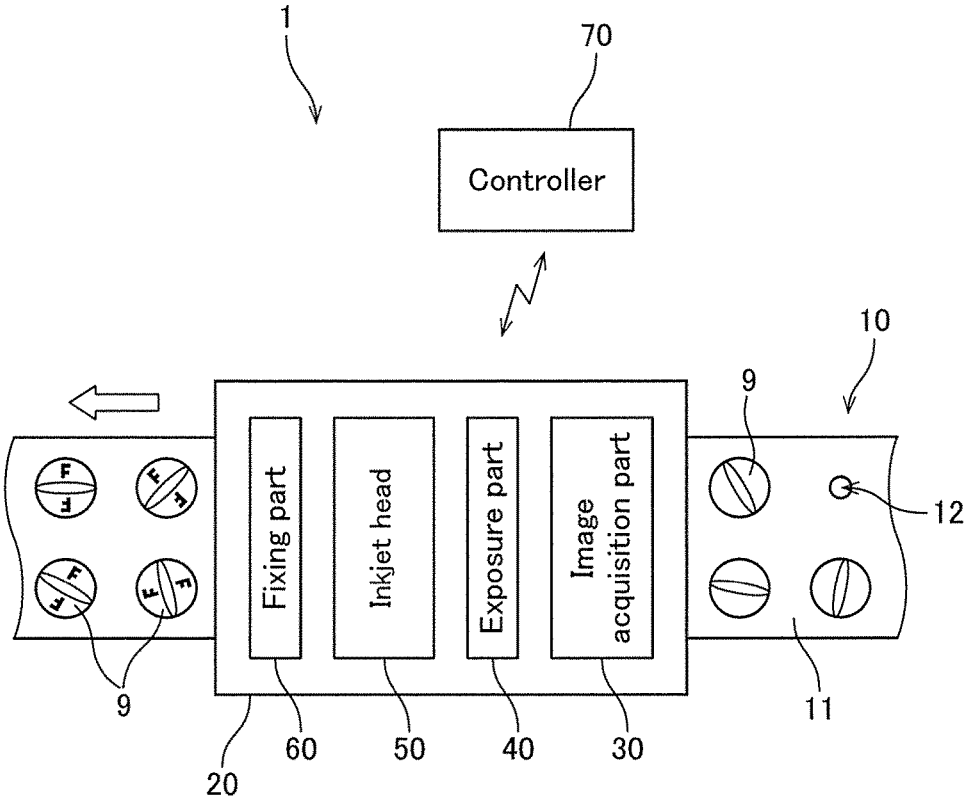
FIG. 1 illustrates a configuration of a tablet printing apparatus according to a first embodiment.

FIG. 1 illustrates a configuration of a tablet printing apparatus 1 according to a first embodiment of the present invention. The tablet printing apparatus 1 is an apparatus for printing an image such as product name, product code, company name, and logo on a surface of each of a plurality of tablets 9 that are medicines, while conveying the tablets 9. As illustrated in FIG. 1, the tablet printing apparatus 1 according to the present embodiment includes a conveying mechanism 10, an exposure and printing part 20, and a controller 70.

The conveying mechanism 10 is a mechanism for holding and conveying the plurality of tablets 9. The conveying mechanism 10 includes a conveying belt 11 that is a ring-shaped flat belt. The conveying belt 11 is looped between a pair of pulleys (not shown). The conveying belt 11 has a plurality of adsorption holes 12. The adsorption holes 12 are regularly arranged in a surface of the conveying belt 11. A suction mechanism (not shown) is provided inside the conveying belt 11. The suction mechanism generates a negative pressure lower than atmospheric pressure at each of the adsorption holes 12. With this negative pressure, the tablets 9 are held by suction one by one in the adsorption holes 12. As the pulleys are rotated by the power of a motor, the conveying belt 11 turns between the pair of pulleys. As a result, the plurality of tablets 9 held on the conveying belt 11 are conveyed in the direction indicated by the hollow arrow in FIG. 1.

The exposure and printing part 20 is a part that determines the orientations (orientations in the direction of rotation about vertical axes passing through the centers of the adsorption holes 12) of the plurality of tablets 9 that are being conveyed by the conveying mechanism 10, and prints a specified image on the surfaces of the tablets 9 on the basis of the results of determination. As illustrated in FIG. 1, the exposure and printing part 20 according to the present embodiment includes an image acquisition part 30, an exposure part 40, an inkjet head 50, and a fixing part 60.

The image acquisition part 30 acquires an image of the plurality of tablets 9 before printing, which are held by suction on the conveying belt 11. The image acquisition part 30 may for example be a camera that includes light receiving elements such as CCDs or CMOSs. The image acquisition part 30 captures an image of the upper surface of the conveying belt 11 from above the conveying belt 11 and transmits obtained image data to the controller 70. The controller 70 detects, on the basis of the received image data, whether the adsorption holes 12 of the conveying belt 11 hold the tablets 9. The controller 70 also detects, on the basis of the received image data, the orientation and position of each tablet 9 held in each adsorption hole 12. On the basis of the detected information, the controller 70 selects data such as exposure data to be used in exposure and print data to be used in inkjet printing, and calculates exposure positions and printing positions.

Figure 2:
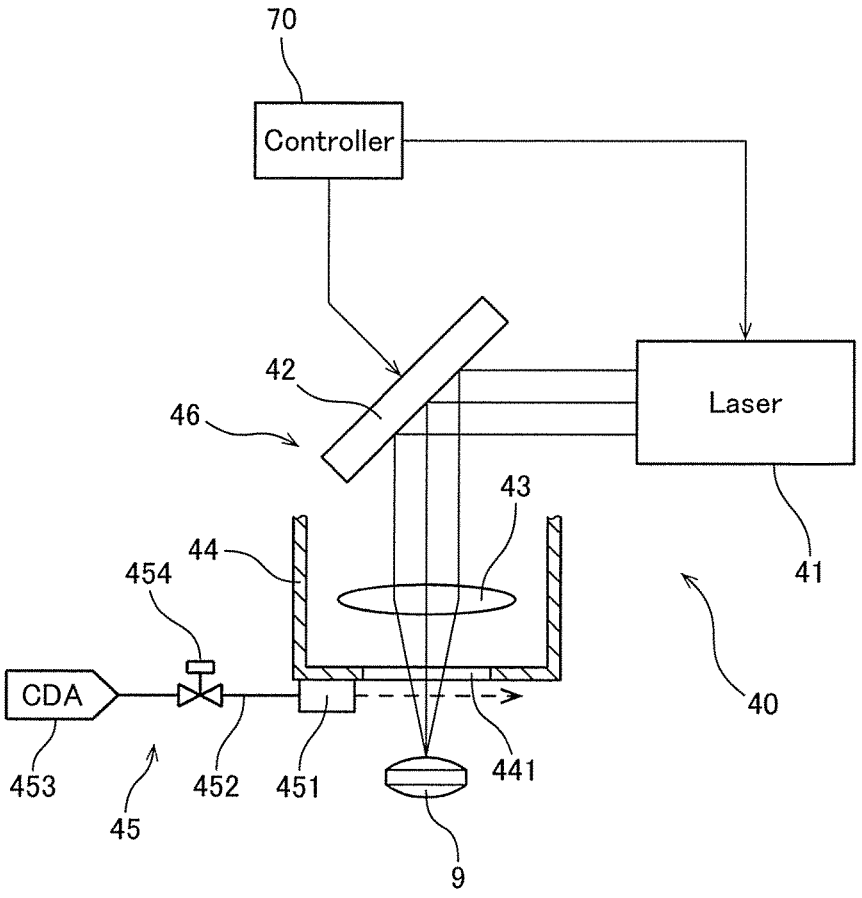
FIG. 2 illustrates a configuration of an exposure part according to the first embodiment.

The exposure part 40 is a part that applies laser light to the surfaces of the tablets 9 that are being conveyed by the conveying mechanism 10. The controller 70 gives an instruction as to light irradiation to the exposure part 40 in accordance with the orientation of each tablet 9 that is being conveyed. The exposure part 40 irradiates the surfaces of the tablets 9 with laser light in accordance with the instruction from the controller 70. FIG. 2 illustrates a configuration of the exposure part 40. As illustrated in FIG. 2, the exposure part 40 according to the present embodiment includes a laser oscillator 41, a spatial light modulator 42, a condenser lens 43, a housing 44, and a blowing mechanism 45.

The laser oscillator 41 is a light source that emits laser light. The laser oscillator 41 according to the present embodiment emits ultraviolet laser light. The wavelength of the laser light is, for example, less than or equal to 400 nm. The laser light emitted from the laser oscillator 41 is guided to the tablets 9 by an optical system 46 configured by the spatial light modulator 42 and the condenser lens 43.

The spatial light modulator 42 is means for reflecting the laser light emitted from the laser oscillator 41 while forming the laser light into an arbitrary shape. The spatial light modulator 42 has a plurality of minute mirrors arranged on a substrate. The spatial light modulator 42 minutely displaces each mirror on the basis of an electrical signal received from the controller 70. Thus, a pattern of irradiation with laser light travelling toward the tablets 9 is formed into a shape that depends on the image to be printed. The spatial light modulator 42 may, for example, be a grating light valve (GLV) (registered trademark) using laser light diffraction, or a digital micro-mirror device (DMD) using reflection. The spatial light modulator 42 may also be a crystal optical element using a refractive index that is changed by the passage of electric current, or a galvanometer mirror capable of forming a pattern of irradiation by a combination of a plurality of rotating mirrors. The laser light formed by the spatial light modulator 42 converges to the condenser lens 43 and irradiates the surfaces of the tablets 9. Thus, the surfaces of the tablets 9 are exposed to the light.

The housing 44 is a casing that houses at least part of the optical system 46. The housing 44 has a bottom surface provided with a window part 441 that is made of an optically transparent material (e.g., clear glass). The window part 441 is located between the condenser lens 43 and the conveying belt 11. The laser light that has passed through the condenser lens 43 passes through the window part 441 and irradiates the surfaces of the tablets 9. The space where the optical system 46 is disposed and the space where the conveying mechanism 10 for the tablets 9 is disposed are isolated from each other by the window part 441. By interposing the window part 441 between the optical system 46 and the conveying belt 11 in this way, it is possible to prevent fine powder generated from the tablets 9 from adhering to the optical system 46.

In the process of producing the tablets 9, components of previously produced tablets remain in each part of production equipment whenever there is a change in the type of the tablets 9. Thus, the production equipment is cleaned at much expense in time and effort in order to prevent newly produced tablets 9 from being mixed and contaminated with the remaining components. The presence of the window part 441 as in the present embodiment prevents the adhesion of chemical components to the precision optical system 46 and further prevents the mixture of the tablets 9 with foreign matter entering from the optical system 46. This alleviates the trouble entailed in cleaning this part, thus contributing to savings in labor during the production process. Additionally, the presence of the window part 441 makes the internal pressure of the space where the optical system 46 is disposed higher than the pressure of the space where the conveying mechanism 10 for the tablets 9 is disposed. This further reduces the risk of the tablet powder finding its way into the optical system 46 from clearance around the window part 441. As a matter of course, it is desirable that the window part 46 be made to have a structure with no clearance by using a sealant.

The blowing mechanism 45 is a mechanism for keeping the lower surface of the window part 441 clean. As illustrated in FIG. 2, the blowing mechanism 45 includes a gas ejection nozzle 451 that is fixed to the lower surface of the housing 44. The gas ejection nozzle 451 is connected to an air supply source 453 via piping 452. An on-off valve 454 is provided in the path of the piping 452. When the on-off valve 454 is opened, clean dry air is supplied from the air supply source 453 through the piping 452 to the gas ejection nozzle 451. The clean dry air is then blown toward the lower surface of the window part 441 (surface on the same side as the conveying mechanism 10) from the gas ejection nozzle 451. The blown clean dry air forms an air layer along the lower surface of the window part 441. This air layer prevents fine powder generated from the tablets 9 from adhering to the lower surface of the window part 441.

The control of the clean dry air is performed by the controller 70. The gas ejected from the blowing mechanism 45 is not limited to clean dry air, and may be other gases (e.g., nitrogen) that do not affect the production of the tablets 9. The blowing mechanism 45 may eject a constant amount of gas all the time, but depending on the process of producing the tablets 9, the blowing mechanism 45 may change the amount of gas to be ejected in a certain time interval, or may temporarily stop the ejection of the gas. In order to save the trouble of cleaning the equipment, a preferable structure is such that a partition wall is disposed between the space where the tablets 9 are conveyed and the space where the parts such as the on-off valve 454 and the controller 70 are disposed so as to isolate both of the spaces from each other. This structure prevents the tablet powder from flying to the on-off valve 454 and the controller 70.

Alternatively, a gas suction nozzle may be installed at a position opposing the gas ejection nozzle 451. If the gas suction nozzle suctions gas while the gas ejection nozzle 451 ejects gas, the gas passing under the lower surface of the window part 441 more reliably forms a laminar flow of the gas. This suppresses the formation of a turbulent flow of the gas in the vicinity of the lower surface of the window part 441.

Referring back to FIG. 1, the inkjet head 50 is a mechanism for ejecting ink droplets toward the surfaces of the tablets 9 after exposure. The inkjet head 50 includes a plurality of nozzles that eject ink droplets. The nozzles are aligned in the width direction on the lower surface of the inkjet head 50. The controller 70, which will be described later, causes the nozzles of the inkjet head 50 to eject ink droplets such that an image is recorded in an appropriate orientation and at an appropriate position on the surface of each tablet 9 in accordance with the orientation of the tablet 9. Accordingly, an image is recorded on the surfaces of the tablets 9 without stopping the conveyance of the tablets 9.

As a method for ejecting ink from the nozzles, for example, what is called a piezo method may for example be used, in which piezo elements that are piezoelectric elements are deformed by the application of voltage so that the ink in the nozzles is ejected under pressure. Alternatively, what is called a thermal method may be used, in which ink in the nozzles is ejected as a result of being heated and expanded by the application of current to a heater. The ink ejected from the inkjet head 50 is an edible ink produced from a raw material approved by the Food Sanitation Act.

The exposure and printing part 20 may include a plurality of inkjet heads 50. For example, four inkjet heads 50 that eject ink of different colors (e.g., cyan, magenta, yellow, and black) may be aligned in the conveyance direction. In this case, single-color images of these colors are superimposed on one another so that a multicolor image is recorded on the surfaces of the tablets 9. This makes the colors used in the logos of pharmaceutical companies printable, thus contributing to enhancing bland recognition of the tablets.

The fixing part 60 is a mechanism for fixing the ink ejected from the inkjet head 50 on the tablets 9. The fixing part 60 is disposed downstream of the inkjet head 50 in the conveyance direction. The fixing part 60 uses, for example, a mechanism for applying infrared rays from a heater to the tablets 9 that are being conveyed by the conveying mechanism 10, or a mechanism for blowing hot air to the tablets 9. The ink adhering to the surfaces of the tablets 9 is dried with infrared rays or hot air and fixed to the surfaces of the tablets 9.

The infrared rays may be applied by one or more of the following methods: continuous irradiation, flash irradiation, and laser irradiation. In the case of using a unit that adopts flash irradiation with infrared rays, heat is supplied to only a layer that is close to the surfaces of the tablets 9. Thus, it is possible to dry the ink adhering to the surfaces of the tablets 9 and to suppress the heating of the inside of the tablets 9. This reduces the influences on pharmaceutical components. Alternatively, print data may be used to irradiate only the area to which ink has been ejected with infrared rays or other light. In this case, the area of the tablets 9 to be irradiated with heat can be reduced. Thus, it is possible to further reduce the influences on pharmaceutical components and on the surface coating of the tablets 9. In the process of passing through the fixing part 60, the tablets 9 are still held on the conveying belt 11. Thus, only a precise print area can be irradiated with infrared rays by using the information about the direction of rotation acquired by the image acquisition part 30 and the print information. As a matter of course, the entire printed area may be irradiated with infrared rays, or only part of the printed area (e.g., only the contour portion of a letter or symbol) may be irradiated with infrared rays. By reducing the amount of infrared rays applied to the tablets 9, it is possible to reduce the risk of deterioration of the tablet components due to heat.

Figure 3:
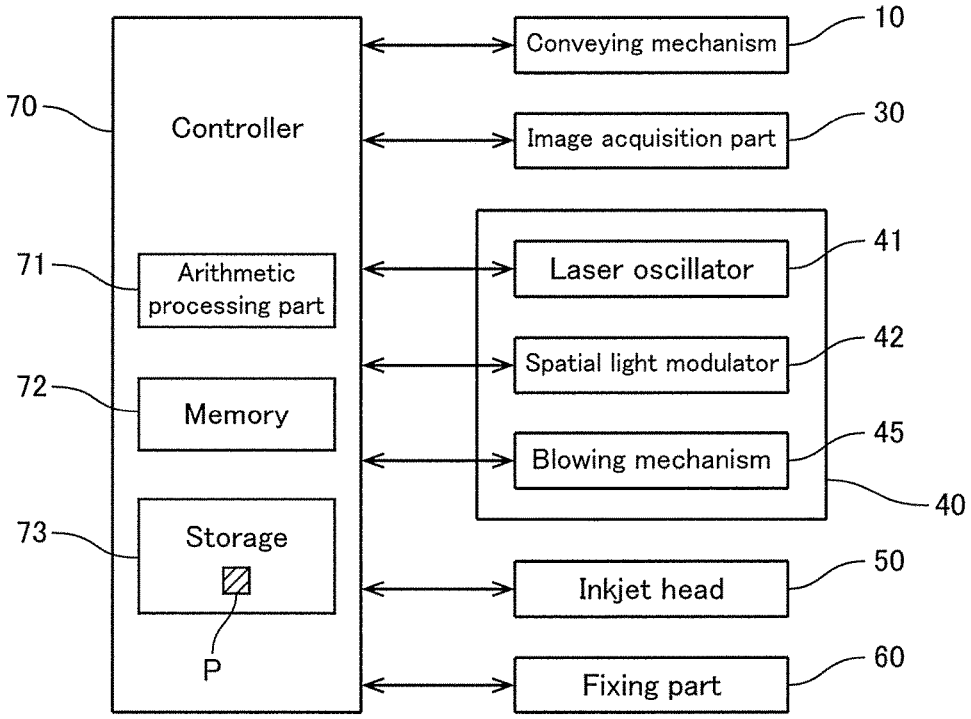
FIG. 3 is a block diagram illustrating a configuration of a control system according to the first embodiment.

The controller 70 is means for controlling operations of each part of the tablet printing apparatus 1. FIG. 3 is a block diagram illustrating connection between the controller 70 and each part of the tablet printing apparatus 1. As schematically illustrated in FIG. 3, the controller 70 is configured by a computer that includes an arithmetic processing part 71 such as a CPU, a memory 72 such as a RAM, and a storage 73 such as a hard disk drive. The storage 73 has installed therein a computer program for executing print processing.

As illustrated in FIG. 3, the controller 70 is communicably connected to each of the above-described parts including the conveying mechanism 10, the image acquisition part 30, the exposure part 40 (which includes the laser oscillator 41, the spatial light modulator 42, and the blowing mechanism 45), the inkjet head 50, and the fixing part 60. The controller 70 controls the operations of each of the above-described parts by temporarily reading out the computer program P and data stored in the storage 73 into the memory 72 and causing the arithmetic processing part 71 to perform arithmetic processing on the basis of the computer program P. Accordingly, print processing is performed on the plurality of tablets 9.

1-2. Exposure and Ink Ejection Processing

As described above, the tablet printing apparatus 1 sequentially performs each processing including image capture, exposure, ink ejection, and fixing on a plurality of tablets 9, which are being conveyed by the conveying mechanism 10. The following is a detailed description of such processing, in particular, exposure and ink ejection processing.

Figure 4:
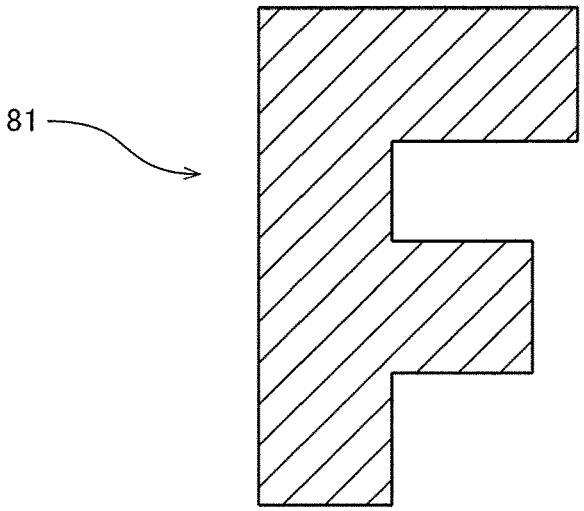
FIG. 4 illustrates an example of a pattern of laser light irradiation according to the first embodiment.

FIG. 4 illustrates a pattern 81 of laser light applied to the surfaces of the tablets 9 by the exposure part 40. The tablet printing apparatus 1 is capable of printing various letters or graphics on the surfaces of the tablets 9 in accordance with input image data. The present embodiment describes by way of example a case in which an image of an alphabet letter F is printed on the surfaces of the tablets 9. The pattern 81 of the laser light applied to the surfaces of the tablets 9 is assumed to have approximately the same shape and size as a print image to be formed on the surfaces of the tablets 9.

Figure 5:
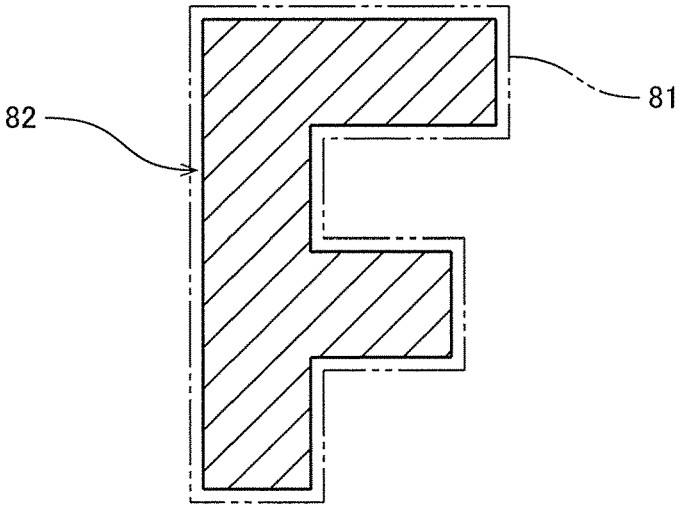
FIG. 5 illustrates an example of the range of ink ejection according to the first embodiment.

FIG. 5 illustrates a range 82 in which the inkjet head 50 ejects ink to the surfaces of the tablets 9. As illustrated in FIG. 5, the range 82 in which ink is ejected to the surfaces of the tablets 9 is an area that overlaps with the pattern 81 of the laser light applied to the surfaces of the tablets 9 and that is slightly smaller (narrower) than the pattern 81 of the laser light. In this way, in the tablet printing apparatus 1, after the exposure part 40 has applied the laser light, the inkjet head 50 ejects ink inside the contour of the pattern 81 formed by the laser light.

Figure 6:
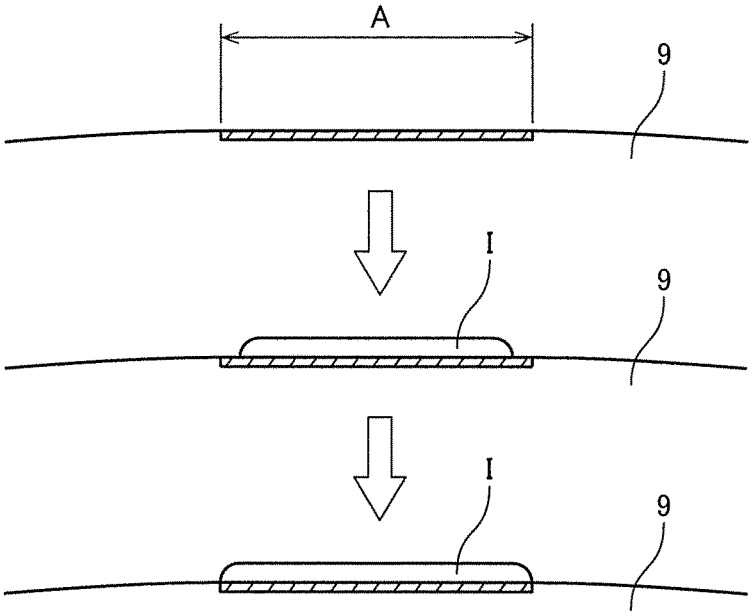
FIG. 6 illustrates a change in the cross-sectional shape of a tablet according to the first embodiment.

FIG. 6 illustrates a change in the cross-sectional shape of the surface of a tablet 9. When the tablet 9 is conveyed to under the exposure part 40, the exposure part 40 irradiates the surface of the tablet 9 with laser light having the pattern 81 illustrated in FIG. 4. Thus, the laser light is applied to an entire target area A of the surface of the tablet 9 where the print image is to be formed. The laser light according to the present embodiment is ultraviolet laser light with a center wavelength of 400 nm or less where the intensity is maximum (the laser light includes components of light with short wavelengths and components of light with long wavelengths, centered at the center wavelength). By the application of the laser light, organic substances in the target area A of the tablet 9 are decomposed, and the target area A is made to have an affinity for water and is roughened as illustrated in the upper section of FIG. 6. That is, the surface shape of the target area A is made to have fine irregularities. As a result, the target area A has greater surface roughness (i.e., becomes coarser) than the other area of the surface of the tablet 9. Additionally, the affinity for water enables water-based ink to more easily adhere to the surface of the tablet 9.

When the tablet 9 has passed under the exposure part 40 and reached a position under the inkjet head 50, the inkjet head 50 ejects ink toward the surface of the tablet 9. At this time, the inkjet head 50 ejects ink to the range 82 that is slightly smaller than the pattern 81 of the laser light as illustrated in FIG. 5. Thus, as illustrated in the middle section of FIG. 6, the area where the ink I first adheres to the surface of the tablet 9 is slightly smaller than the contour portion of the target area A.

The roughened target area A has a smaller angle of contact with the ink I than the other area. Thus, the ink I ejected inside the target area A spreads from the ejected position to the surroundings as illustrated in the lower section of FIG. 6. However, the ink I is unlikely to spread to the outside of the target area A because the area outside the target area A is not roughened and therefore has a large angle of contact with the ink I. Accordingly, the spread of the ink I stops at the boundary between the target area A and the outside area. As a result, a print image with a well-defined contour can be formed on the surface of the tablet 9.

2. Second Embodiment

Next, a second embodiment according to the present invention will be described.

While the laser oscillator 41 according to the above-described first embodiment emits ultraviolet laser light, the laser oscillator 41 according to the second embodiment emits infrared laser light. The center wavelength of the laser light is assumed to be, for example, 700 nm or more. The configuration of the tablet printing apparatus 1 is identical to that in the above-described first embodiment, and redundant descriptions thereof will be omitted. The tablet printing apparatus 1 according to the second embodiment also sequentially performs each processing including image capture, exposure, ink ejection, and fixing on a plurality of tablets 9 that are being conveyed by the conveying mechanism 10.

In the present embodiment, the pattern 81 of the laser light applied to the surfaces of the tablets 9 by the exposure part 40 is assumed to be the same as that illustrated in FIG. 4. That is, the pattern 81 of the laser light applied to the surfaces of the tablets 9 is assumed to have approximately the same shape and size as a print image to be formed on the surfaces of the tablets 9. The range 82 in which the inkjet head 50 ejects ink to the surfaces of the tablets 9 is also assumed to be the same as that illustrated in FIG. 5. That is, the range 82 in which ink is ejected to the surfaces of the tablets 9 is an area that overlaps with the pattern 81 of the laser light applied to the surface of the tablet 9 and that is slightly smaller (narrower) than the pattern 81 of the laser light.

Figure 7:
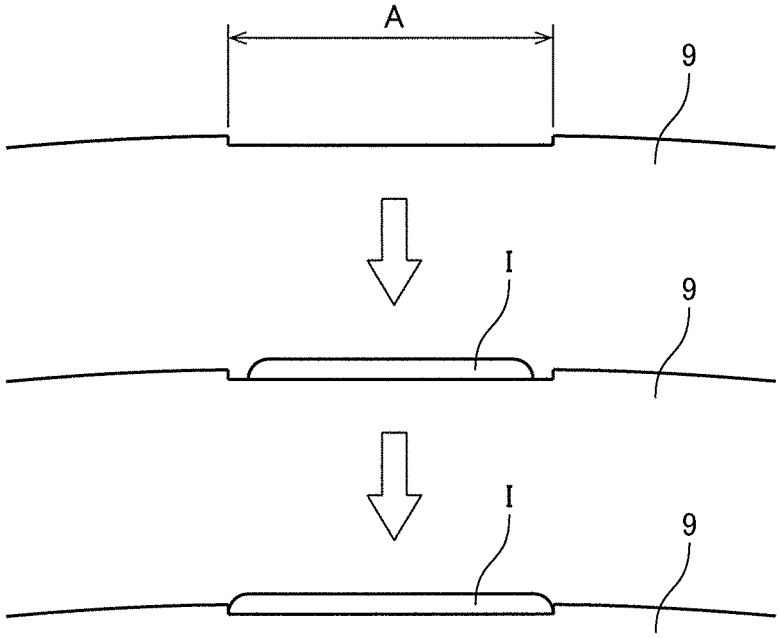
FIG. 7 illustrates a change in the cross-sectional shape of a tablet according to a second embodiment.

FIG. 7 illustrates a change in the cross-sectional shape in the vicinity of the surface of a tablet 9 according to the second embodiment. When the tablet 9 is conveyed to under the exposure part 40, the exposure part 40 irradiates the surface of the tablet 9 with laser light having the pattern 81 illustrated in FIG. 4. Thus, the laser light is applied to the entire target area A of the surface of the tablet 9 where a print image is to be formed. The laser light according to the present embodiment is infrared laser light with a center wavelength of 700 nm or more. Thus, as illustrated in the upper section of FIG. 7, the target area A of tablet 9 is etched into a recessed shape by the application of the laser light. That is, the surface shape of the target area A is dug entirely. As a result, a recess is formed in the entire target area A.

When the tablet 9 has passed under the exposure part 40 and reached a position under the inkjet head 50, the inkjet head 50 ejects ink toward the surface of the tablet 9. At this time, the inkjet head 50 ejects ink to the range 82 that is slightly smaller than the pattern 81 of the laser light as illustrated in FIG. 5. Thus, as illustrated in the middle section of FIG. 6, the area where the ink I first adheres to the surface of the tablet 9 is slightly smaller than the contour portion of the target area A.

The ink I ejected inside the target area A spreads from the ejected position to the surroundings as illustrated in the lower section of FIG. 7. In the present embodiment, the target area A after exposure is recessed more than the other area. Thus, the ink I is unlikely to spread to the outside of the target area A, although it easily spreads within the target area A. Accordingly, the spread of the ink I stops at the boundary between the target area A and the outside area. As a result, a print image with a well-defined contour can be formed on the surface of the tablet 9. Additionally, the etched portion is filled with the ink. This improves the adhesion of the ink to the tablet 9 and increases the thickness of an ink layer, thus reducing the risk of deterioration that may be caused by separation or rubbing of the ink layer.

3. Third Embodiment

Next, a third embodiment according to the present invention will be described.

Figure 8:
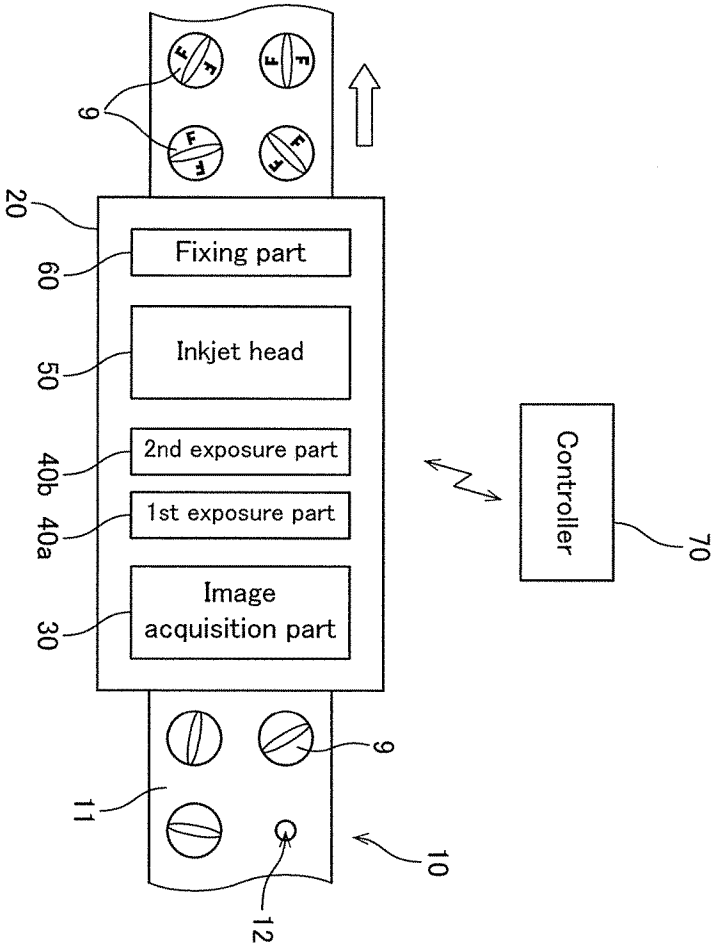
FIG. 8 illustrates a configuration of a tablet printing apparatus according to a third embodiment.

FIG. 8 illustrates a configuration of the tablet printing apparatus 1 according to the third embodiment. The tablet printing apparatus 1 according to the present embodiment includes a first exposure part 40*a* and a second exposure part 40*b* that is located downstream of the first exposure part 40*a* in the conveyance direction. The first exposure part 40*a* and the second exposure part 40*b* both have identical configurations to that of the exposure part 40 according to the above-described first embodiment. Although the laser oscillator 41 according to the above-described embodiments emits ultraviolet laser light, both of the laser oscillators 41 of the first exposure part 40*a* and the second exposure part 40*b* according to the present embodiment emit infrared laser light. The center wavelength of the laser light is assumed to be, for example, 700 nm or more.

The configuration of the tablet printing apparatus 1 other than the exposure parts is identical to that in the above-described first embodiment, and redundant descriptions thereof will be omitted. The tablet printing apparatus 1 according to the third embodiment also sequentially performs each processing including image capture, exposure, ink ejection, and fixing on a plurality of tablets 9 that are being conveyed by the conveying mechanism 10.

Figure 9:
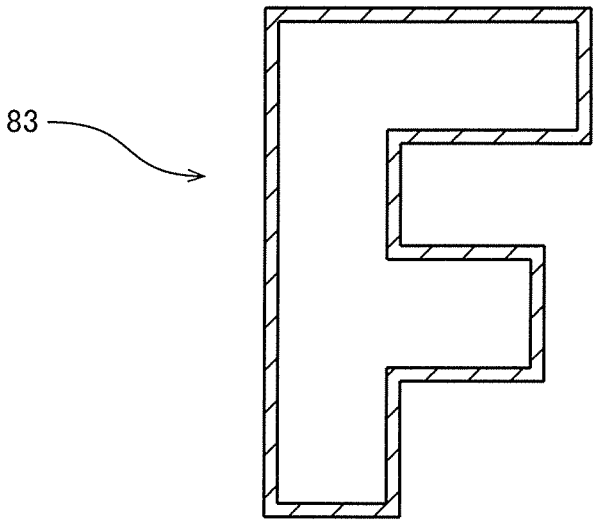
FIG. 9 illustrates an example of a pattern of laser light irradiation according to the third embodiment.

The pattern 81 of the laser light applied from the first exposure part 40*a* to the surfaces of the tablets 9 is assumed to be the same as that illustrated in FIG. 4. That is, the pattern 81 of the laser light applied from the first exposure part 40*a* to the surfaces of the tablets 9 is assumed to have approximately the same shape and size as a print image to be for rued on the surfaces of the tablets 9. FIG. 9 illustrates a pattern 83 of the laser light applied from the second exposure part 40*b* to the surfaces of the tablets 9. As illustrated in FIG. 9, the pattern 83 of the laser light applied from the second exposure part 40*b* to the surfaces of the tablets 9 is a ring-shaped pattern that overlaps with the print image to be formed on the surfaces of the tablets 9 and that extends along the contour of the print image to be formed on the surfaces of the tablets 9.

The range 82 in which the inkjet head 50 ejects ink to the surfaces of the tablets 9 is assumed to be the same as that illustrated in FIG. 5. That is, the range 82 in which ink is ejected to the surfaces of the tablets 9 is an area inside the ring-shaped pattern 83 that is the range in which the second exposure part 40*b* applies laser light.

Figure 10:
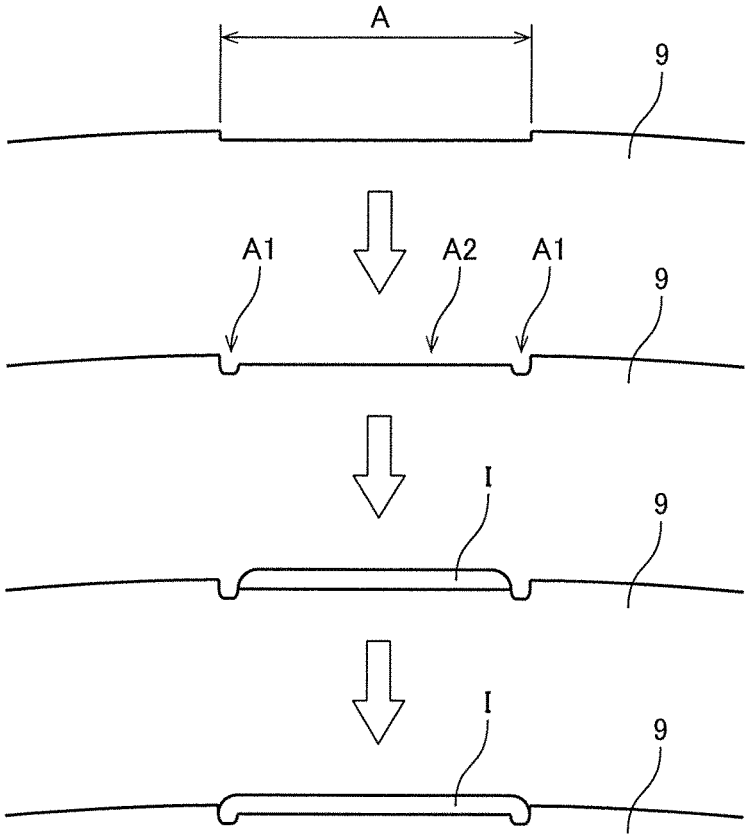
FIG. 10 illustrates a change in the cross-sectional shape of a tablet according to the third embodiment.

FIG. 10 illustrates a change in the cross-sectional shape in the vicinity of the surface of a tablet 9 according to the third embodiment. When the tablet 9 is conveyed to under the first exposure part 40*a*, the first exposure part 40*a* irradiates the surface of the tablet 9 with laser light having the pattern 81 illustrated in FIG. 4. Thus, the laser light is applied to the entire target area A of the surface of the tablet 9 where the print image is to be formed. The laser light according to the present embodiment is infrared laser light with a center wavelength of 700 nm or more. Thus, as illustrated in the uppermost section of FIG. 10, the target area A of the tablet 9 is etched into a recessed shape by the application of the laser light. That is, the surface shape of the target area A is dug entirely. As a result, a recess is formed in the entire target area A.

When the tablet 9 has passed under the first exposure part 40*a* and reached a position under the second exposure part 40*b*, the second exposure part 40*b* irradiates the surface of the tablet 9 with laser light having the pattern 83 illustrated in FIG. 9. Thus, only a contour portion A1 of the target area A of the surface of the tablet 9 is additionally irradiated with the laser light. Accordingly, the amount of infrared rays applied per unit area to the contour portion A1 is greater than the amount of infrared rays applied per unit area to an inside portion A2 surrounded by the contour portion A1. As a result, the contour portion A1 is etched more deeply than the inside portion A2 as illustrated in the second section from the top of FIG. 10.

When the tablet 9 has passed under the second exposure part 40*b* and reached a position under the inkjet head 50, the inkjet head 50 ejects ink toward the surface of the tablet 9. At this time, the inkjet head 50 ejects ink to the inside of the range in which the second exposure part 40*b* applies laser light as illustrated in FIG. 5. Thus, the ink I adheres to the inside portion A2 surrounded by the contour portion A1 of the target area A as illustrated in the third section from the top of FIG. 10.

The ink I ejected to the inside portion A2 spreads from the ejected position to the surroundings as illustrated in the lowermost section of FIG. 10. In the present embodiment, the target area A after exposure is recessed more than the other area. The contour portion A1 of the target area A is recessed yet more than the inside portion A2. Thus, the ink I is unlikely to spread to the outside of the contour portion A1, although it easily spreads from the inside portion A2 to the contour portion A1. Accordingly, the spread of the ink I stops at the boundary between the target area A and the outside area. As a result, a print image with a well-defined contour can be formed on the surface of the tablet 9.

While the present embodiment describes an example in which firstly the first exposure part 40*a* exposes both of the contour portion A1 and the inside portion A2 and then the second exposure part 40*b* exposes only the contour portion A1, the order of exposure may be reversed. That is, only the contour portion A1 may be exposed firstly, and then both of the contour portion A1 and the inside portion A2 may be exposed.

Instead of using the plurality of exposure parts 40*a* and 40*b*, a single exposure part may be controlled such that the amount of laser light applied per unit area to the contour portion A1 is greater than the amount of laser light applied per unit area to the inside portion A2. More specifically, for example, an element such as a DMD that has two-dimensionally aligned minute mirrors may be used as the spatial light modulator 42, and a plurality of mirror rows aligned in the conveyance direction may be controlled after being divided into mirror rows that irradiate the entire target area A with laser light and mirror rows that irradiate only the contour portion A1 with laser light. In the case of the spatial light modulator 42 with a two-dimensional array, a plurality of mirrors move relative to the tablets 9 in the conveyance direction. Thus, even if light is applied from only a single exposure part, it is possible to create a plurality of areas that are irradiated with different amounts of light by changing the number of times the mirrors are turned on or off for each area.

4. Fourth Embodiment

Next, a fourth embodiment according to the present invention will be described.

The tablet printing apparatus 1 according to the fourth embodiment has a configuration identical to that of the tablet printing apparatus 1 according to the third embodiment illustrated in FIG. 8. That is, the tablet printing apparatus 1 according to the fourth embodiment includes the first exposure part 40*a* and the second exposure part 40*b* that is located downstream of the first exposure part 40*a* in the conveyance direction. The first exposure part 40*a* and the second exposure part 40*b* both emit infrared laser light from their laser oscillators 41. The center wavelength of the laser light is assumed to be, for example, 700 nm or more.

The configuration of the tablet printing apparatus 1 other than the exposure parts is identical to that in the above-described first embodiment, and redundant descriptions thereof will be omitted. The tablet printing apparatus 1 according to the fourth embodiment also sequentially performs each processing including image capture, exposure, ink ejection, and fixing on a plurality of tablets 9 that are being conveyed by the conveying mechanism 10.

Figure 11:
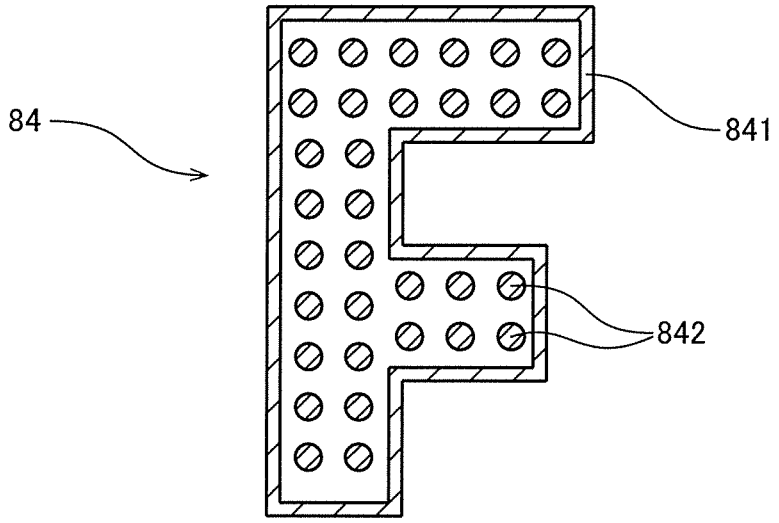
FIG. 11 illustrates an example of a pattern of laser light irradiation according to a fourth embodiment.

In the present embodiment, the pattern 81 of the laser light applied from the first exposure part 40*a* to the tablets 9 is assumed to be identical to that illustrated in FIG. 4. That is, the pattern 81 of the laser light applied from the first exposure part 40*a* to the surfaces of the tablets 9 is assumed to have approximately the same shape and size as a print image to be formed on the surfaces of the tablets 9. FIG. 11 illustrates a pattern 84 of the laser light applied from the second exposure part 40*b* to the surfaces of the tablets 9. As illustrated in FIG. 11, the pattern 84 of the laser light applied from the second exposure part 40*b* to the surfaces of the tablets 9 includes a ring-shaped pattern 841 and a plurality of isolated patterns 842, the ring-shaped pattern 841 being a pattern that overlaps with the print image to be formed on the surfaces of the tablets 9 and that extends along the contour of the print image to be formed on the surfaces of the tablets 9, and the isolated patterns 842 being patterns that are regularly arranged inside the ring-shaped pattern 841.

The range 82 in which the inkjet head 50 ejects ink to the surfaces of the tablets 9 is assumed to be identical to that illustrated in FIG. 5. That is, the range 82 in which ink is ejected to the surfaces of the tablets 9 is an area that overlaps with the aforementioned plurality of isolated patterns 842 and that is inside the aforementioned ring-shaped pattern 841.

Figure 12:
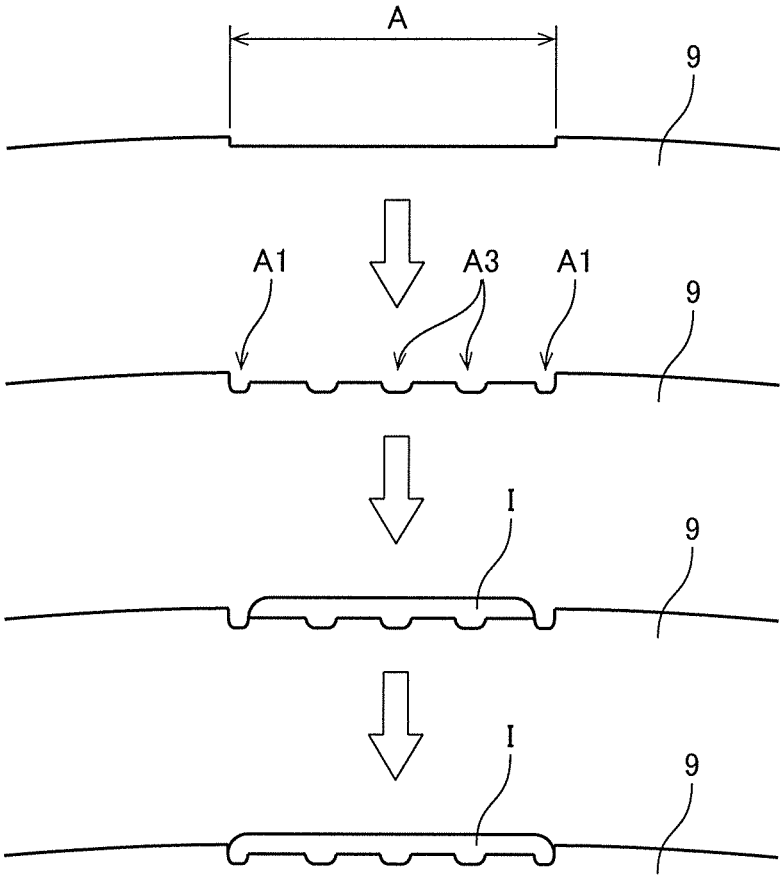
FIG. 12 illustrates a change in the cross-sectional shape of a tablet according to the fourth embodiment.

FIG. 12 illustrates a change in the cross-sectional shape in the vicinity of the surface of a tablet 9 according to the fourth embodiment. When the tablet 9 is conveyed to under the first exposure part 40*a*, the first exposure part 40*a* irradiates the surface of the tablet 9 with laser light having the pattern 81 illustrated in FIG. 4. Thus, the laser light is applied to the entire target area A of the surface of the tablet 9 where the print image is to be formed. The laser light according to the present embodiment is infrared laser light with a center wavelength of 700 nm or more. Thus, as illustrated in the uppermost section of FIG. 12, the target area A of the tablet 9 is etched into a recessed shape by the application of the laser light. That is, the surface shape of the target area A is dug entirely. As a result, a recess is formed in the entire target area A.

When the tablet 9 has passed under the first exposure part 40*a* and reached a position under the second exposure part 40*b*, the second exposure part 40*b* irradiates the surface of the tablet 9 with laser light having the pattern 84 illustrated in FIG. 11. Thus, the laser light is additionally applied to both of a contour portion A1 of the target area A of the surface of the tablet 9 and a plurality of isolated portions A3 located inside the contour portion A1. Accordingly, the amount of infrared rays applied per unit area to the contour portion A1 and the isolated portions A3 of the target area A is greater than the amount of infrared rays applied per unit area to the other portion of the target area A. As a result, the contour portion A1 and the isolated portions A3 are etched more deeply than the other portion of the target area A as illustrated in the second section from the top of FIG. 12.

When the tablet 9 has passed under the second exposure part 40*b* and reached a position under the inkjet head 50, the inkjet head 50 ejects ink toward the surface of the tablet 9. Thus, the ink adheres to an inside portion surrounded by the contour portion A1 of the target area A as illustrated in the third section from the top of FIG. 12.

The ink ejected to the inside portion A2 spreads from the ejected position to the surroundings as illustrated in the lowermost section of FIG. 12. In the present embodiment, the target area A after exposure is recessed more than the other area. Thus, the ink is unlikely to spread to the outside of the contour portion A1. Accordingly, the spread of the ink stops at the boundary between the target area A and the outside area. As a result, a print image with a well-defined contour can be formed on the surface of the tablet 9.

In the present embodiment, the plurality of isolated portions A3 (first areas) and portions (second areas) that are etched shallower than the isolated portions A3 are alternately arranged inside the contour portion A1. This further suppresses the flow of the ink. Accordingly, the spread of the ink to the outside of the target area A is further suppressed. In particular, when the target area A of the tablet 9 is in a plane inclined with respect to a horizontal plane, it is necessary to suppress the flow of ink caused by gravity. The present embodiment is in particular effective in such a case.

While the present embodiment describes an example in which firstly the first exposure part 40*a* exposes the entire target area A and then the second exposure part 40*b* exposes the contour portion A1 and the plurality of isolated portions A3, the order of exposure may be reversed. That is, the contour portion A1 and the plurality of isolated portions A3 may be exposed firstly, and then the entire target area A may be exposed.

Instead of using the plurality of exposure parts 40*a* and 40*b*, a single exposure part may be controlled such that the amount of laser light applied per unit area to the contour portion A1 and the plurality of isolated portions A3 is greater than the amount of laser light applied per unit area to the other portion. More specifically, for example, an element such as a DMD that has two-dimensionally aligned minute mirrors may be used as the spatial light modulator 42, and a plurality of mirror rows aligned in the conveyance direction may be controlled after being divided into mirror rows that irradiate the entire target area A with laser light and mirror rows that irradiate only the contour portion A1 and the plurality of isolated portions A3 with laser light. In the case of the spatial light modulator 42 with a two-dimensional array, a plurality of mirrors move relative to the tablets 9 in the conveyance direction. Thus, even if light is applied from only a single exposure part, it is possible to create a plurality of areas that are irradiated with different amounts of light by changing the number of times the mirrors are turned on or off for each area.

The aforementioned second area does not necessarily have to be irradiated with infrared rays. In that case, the first exposure part 40*a* may be omitted, and the second exposure part 40*b* may expose only the contour portion A1 and the plurality of isolated portions A3.

5. Variations

While the above has been a description of main embodiments of the present invention, the present invention is not intended to be limited to the embodiments described above.

While the above embodiments describe examples in which the exposure part 40 emit either ultraviolet rays or infrared rays, ultraviolet laser light and infrared laser light may be used in combination. For example, in the configuration illustrated in FIG. 8, the first exposure part 40*a* may emit infrared laser light and the second exposure part 40*b* may emit ultraviolet laser light. This achieves the effect of preventing the spread of ink by etching, the effect of preventing the spread of ink by using a difference in the angle of contact with ink, the difference being produced as a result of surface roughening, and the effect of improving the adhesion of ink. Accordingly, it is possible to further suppress the spread of the ink ejected from the inkjet head 50 to the outside of the target area A.

While the above-described embodiments use the reflective spatial light modulator 42 to form laser light into a desired pattern, a translucent crystal optical element may be used, instead of the spatial light modulator 42. Since the translucent crystal optical element generally has high durability, the use of the crystal optical element enables the use of laser light with higher intensity and the long-term application of laser light. As a result, it is possible to reduce risks such as the risk of the apparatus being stopped due to a malfunction in the optical element of the exposure part 40 during the process of producing tablets. The exposure part 40 only needs to be capable of applying either ultraviolet rays or infrared rays emitted from the light source to the tablets 9 while forming the ultraviolet or infrared rays into a specified pattern.

While in the above-described embodiments, the exposure part 40 applies laser light to the surfaces of the tablets 9, the light applied to the tablets 9 does not necessarily have to be laser light. The light source of the exposure part 40 only needs to be a light source capable of applying ultraviolet rays or infrared rays.

While in the above-described embodiments, the pattern of irradiation with laser light is an area that is the same as or smaller than the print area, the exposure part 40 may, of course, irradiate an area larger than the print area with laser light. In the case where the performance of inkjet printing is improved by reforming the surfaces of the tablets 9 as in the case of ultraviolet irradiation, it is possible to improve even the printing performance of printing using water-based ink, which has been difficult with conventional techniques due to water repellency of tablet surfaces. By applying laser light to an area larger than the print area, clear printing is possible even if the accuracy of alignment between the position exposed with laser light and the position for inkjet printing is somewhat low. Thus, it is possible to convey the tablets 9 at a higher speed and to smooth out variations in the positional accuracy of the conveying belt 11. As a result, even a conveyance system that somewhat sacrifices accuracy can be adopted, and this contributes to a reduction in the cost of the apparatus.

By using the printing method according to the embodiments and variations described above, an ink layer is formed within the recess. Thus, it is possible to make the ink layer thicker than in conventional inkjet printing. The adhesion of ink to the tablets can also be improved. Thus, even if tablets rub against each other in a bottle, a reduction in print quality does not easily occur. The use of the printing method according to the embodiments and variations described above also improves the print quality of the contour portion. Thus, clear printing of bar codes or QR codes (registered trademark) for use in management is possible. This reduces the number of tablets to be discarded due to print defects. Additionally, smaller-sized codes can be printed distinguishably.

With the printing method according to the embodiments and variations described above, it is possible through the combined use of recesses and inkjet printing to print forgery prevention patterns that can be checked visually or that are difficult to check visually, on tablets. This contributes to protecting the interests of pharmaceutical companies.

The detailed configuration of the tablet printing apparatus 1 may differ from the configurations illustrated in the drawings of the present specification. Each element in the embodiments and variations described above may be appropriately combined within a range that presents no contradictions.

REFERENCE SIGNS LIST

1 Tablet printing apparatus
9 Tablet
10 Conveying mechanism
11 Conveying belt
12 Adsorption hole
20 Exposure and printing part
30 Image acquisition part
40 Exposure part
40*a* First exposure part
40*b* Second exposure part
41 Laser oscillator
42 spatial light modulator
43 Condenser lens
44 Housing
45 Blowing mechanism
46 Optical system
50 Inkjet head
60 Fixing part
70 Controller
441 Window part
A Target area
A1 Contour portion
A2 Inside portion
A3 Isolated portion

The invention claimed is:

1. A tablet printing apparatus for performing printing on a surface of a tablet, comprising:
a conveying mechanism that holds and conveys a tablet;
an exposure part that applies at least one of ultraviolet rays and infrared rays to a surface of a tablet that is conveyed by said conveying mechanism; and
an inkjet head that ejects ink toward a surface of a tablet that has passed through said exposure part,
wherein said exposure part applies at least one of ultraviolet rays and infrared rays to at least a contour portion of a target area where a print image is to be formed, and
said inkjet head ejects ink inside said contour portion.

2. The tablet printing apparatus according to claim 1, wherein
said exposure part applies at least ultraviolet rays to a surface of a tablet.

3. The tablet printing apparatus according to claim 1, wherein
said exposure part applies at least infrared rays to a surface of a tablet.

4. The tablet printing apparatus according to claim 3, wherein
said target area includes:
said contour portion; and
an inside portion surrounded by said contour portion, and
an amount of infrared rays applied per unit area to said contour portion is greater than an amount of infrared rays applied per unit area to said inside portion.

5. The tablet printing apparatus according to claim 4, wherein
said exposure part includes one or more exposure parts that apply infrared rays to both of said contour portion and said inside portion.

6. The tablet printing apparatus according to claim 3, wherein
said target area includes:
a first area that is irradiated with infrared rays; and
a second area that is irradiated with a smaller amount of infrared rays per unit area than said first area, or that is not irradiated with infrared rays, and
said first area and said second area are alternately arranged in said target area.

7. The tablet printing apparatus according to claim 1, wherein
said exposure part applies at least one of ultraviolet rays and infrared rays to a surface of a tablet via a spatial light modulator or a crystal optical element.

8. The tablet printing apparatus according to claim 1, wherein
said exposure part includes:
a light source that emits at least one of ultraviolet rays and infrared rays;
an optical system that guides the light emitted from said light source to a tablet; and
a housing that houses at least part of said optical system and has an optically transparent window part located between said optical system and said conveying mechanism.

9. The tablet printing apparatus according to claim 8, wherein
said exposure part further includes a blowing mechanism for blowing gas to a surface of said window part, the surface being on the same side as said conveying mechanism.

10. The tablet printing apparatus according to claim 1, wherein
said exposure part emits at least one of ultraviolet laser light and infrared laser light.

11. The tablet printing apparatus according to claim 1, further comprising:
a fixing part disposed downstream of said inkjet head in a conveyance direction,
wherein said fixing part applies infrared rays to an irradiation area by one or more of following methods: continuous irradiation, flash irradiation, and laser irradiation, the irradiation area including at least part of a print area of a surface of a tablet.

12. A tablet printing method for performing printing on a surface of a tablet, comprising:
a) applying at least one of ultraviolet rays and infrared rays to a surface of a tablet that is conveyed; and
b) ejecting ink toward the surface of the tablet after said operation a),
wherein in said operation a), at least one of ultraviolet rays and infrared rays is applied to at least a contour portion of a target area where a print image is to be forming, and
in said operation b), ink is ejected inside said contour portion.

13. The tablet printing method according to claim 12, wherein
in said operation a), at least ultraviolet rays are applied to a surface of a tablet.

14. The tablet printing method according to claim 12, wherein
in said operation a), at least infrared rays are applied to a surface of a tablet.

15. The tablet printing method according to claim 14, wherein
said target area includes:
said contour portion; and
an inside portion surrounded by said contour portion,
wherein an amount of infrared rays applied per unit area to said contour portion is greater than an amount of infrared rays applied per unit area to said inside portion.

16. The tablet printing method according to claim 15, wherein
said operation a) includes:
a-1) applying infrared rays to both of said contour portion and said inside portion; and
a-2) applying infrared rays to only said contour portion before or after said operation a-1).

17. The tablet printing method according to claim 14, wherein said target area includes:

a first area that is irradiated with infrared rays; and a second area that is irradiated with a smaller amount of infrared rays per unit area than said first area, or that is not irradiated with infrared rays, and said first area and said second area are alternately arranged in said target area.

18. The tablet printing method according to claim 12, wherein in said operation a), at least one of ultraviolet rays and infrared rays is applied to a surface of a tablet via a spatial light modulator or a crystal optical element.

19. The tablet printing method according to claim 12, wherein in said operation a), at least one of ultraviolet laser light and infrared laser light is applied.

20. The tablet printing method according to claim 12, further comprising a step of:

after said operation b), applying infrared rays to an irradiation area by one or more of following methods: continuous irradiation, flash irradiation, and laser irradiation, the irradiation area including at least part of a print area of a surface of a tablet.

* * * * *